4/12/83 XR 4,380,012

United States Patent [19]

Bevan et al.

[11] 4,380,012

[45] Apr. 12, 1983

[54] RADOME FOR AIRCRAFT

[75] Inventors: David Bevan, Media, Pa.; James S. Yee, Seattle, Wash.; Richard R. Pruyn, Valley Forge, Pa.

[73] Assignee: The Boeing Company, Seattle, Wash.

[21] Appl. No.: 284,029

[22] Filed: Jul. 17, 1981

[51] Int. Cl.[3] ..... G09F 9/30

[52] U.S. Cl. ..... 343/705; 343/872

[58] Field of Search ..... 343/705, 872, 854, 801, 343/800, 798, 700 MS

[56] References Cited

U.S. PATENT DOCUMENTS 3,656,164 4/1972 Rempt ..... 343/872

3,715,759 6/1973 Esposito et al. ..... 343/872

3,996,592 12/1976 Kline et al. ..... 343/876

*Primary Examiner*—David K. Moore

*Attorney, Agent, or Firm*—Jones, Tullar & Cooper

[57] ABSTRACT

A non-rotatable radar antenna installation for aircraft for providing 360° azimuthal scanning, which includes a generally triangular radome carried by the aircraft, and three substantially planar radar antennas arranged in a triangular planform within the radome. 360° azimuthal coverage is achieved by the sequential side-to-side scanning of the three antennas. The planform area of the triangular radome and consequently the drag and weight penalty of the radome upon the aircraft is substantially less than equivalent radar antenna installations of circular configuration.

20 Claims, 9 Drawing Figures

RADOME FOR AIRCRAFT

BACKGROUND OF THE INVENTION

The invention relates to antenna installations and more particularly to an aircraft radar antenna which is disposed within, and affixed to, a radome carried by the aircraft.

Large rotatable radomes for aircraft, such as those described in U.S. Pat. No. 3,026,516, issued Mar. 20, 1962 to E. M. Davis and U.S. Pat. No. 3,045,236, issued July 17, 1962 to P. A. Colman et al, in which a radar antenna disposed within the radome is rotated with it to effect 360 degrees azimuthal scanning, are well known to the aircraft industry. However, these rotatable radomes must have a substantially circular planform in order to avoid inducing lateral, directional, or pitching loads upon the aircraft as the radome is rotated. Also, these rotatable circular radomes cannot be aerodynamically streamlined, or faired, to conform to the local airflow around the aircraft in flight. These circular rotatable radomes are supported on a center shaft which must resist any pitching loads on the radome; consequently, the center shaft is a relatively heavy structure in comparison to a fixed structure with support members which are spaced to better distribute the loads acting on the radome.

OBJECTS AND SUMMARY OF THE INVENTION

It is an object of the invention to provide a radar antenna installation for an aircraft which is affixed within a non-rotatable radome carried by the aircraft and which provides 360 degrees azimuthal scanning.

It is a further object of the invention to provide this radar installation and radome in a geometric configuration such that the planform area of the radome is subtantially less than the planform area of a radome carrying an equivalent antenna installation in a circular configuration, to thus minimize the drag and weight penalty of the radome upon the aircraft. It is a related object to provide a radome having a geometric configuration which can be easily aerodynamically streamlined to accomodate local airflow about the radome during flight.

The radome, according to the invention, includes three planar phased-array radar antennas arranged in a substantially equilateral triangular planform with the three antennas facing outward from the triangle. Each antenna is constructed with phased arrays of antenna elements which permit the transmitted radar beam to be electronically scanned from side-to-side. A 360 degree azimuthal coverage is achieved by the sequential side-to-side scanning of the three antennas.

This delta arrangement of three phased-array antennas permits the same transmitter, radio frequency source, beam forming equipment, and other equipment to be switched between the three antennas. This reduces the number of components and space required for these components, and also permits an irregular scanning rate or intermittent scanning of any azimuth as desired.

The structure is based upon three generally elliptical groundplanes which are covered on the leading, and trailing edges by radome surfaces of composites or other nonconductive materials. The upper and lower coverings inside the triangular planform support the transmitting and receiving electronic equipment and the cooling system for the antennas.

The antenna elements may be flush elements, printed circuit dipoles, YAGI-UDA type elements or other known elements which can be phased to scan the beam.

The radome may be mounted either above or below the aircraft fuselage, by either fixed or extendable, retractable struts. The radome is mounted symmetrically with respect to the aircraft fuselage, with either one side or an apex of the generally triangular radome being disposed towards the front of the aircraft.

The radome may have typically rounded leading edges and tapered trailing edges and the upper and lower covers may have longitudinal or lateral camber to best accommodate local aerodynamic flow of air about the radome during flight.

The invention will be better understood and further objects and advantages thereof will become more apparent from the ensuing detailed description of a preferred embodiment, taken in conjunction with the drawings.

DESCRIPTION OF A PREFERRED EMBODIMENT

Figure 1:
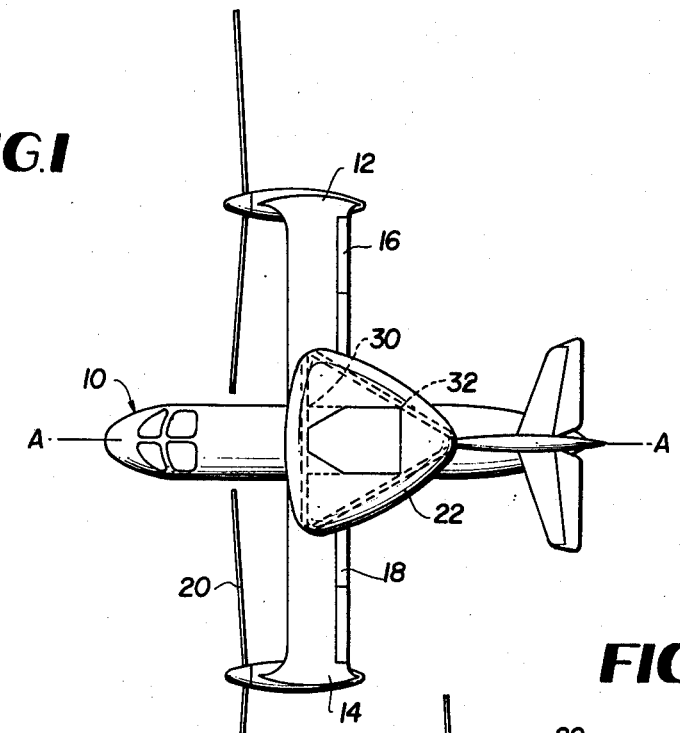
FIG. 1 is a plan view of a typical tilt rotor aircraft carrying a delta radar antenna and radome, according to the invention.
Figure 2:
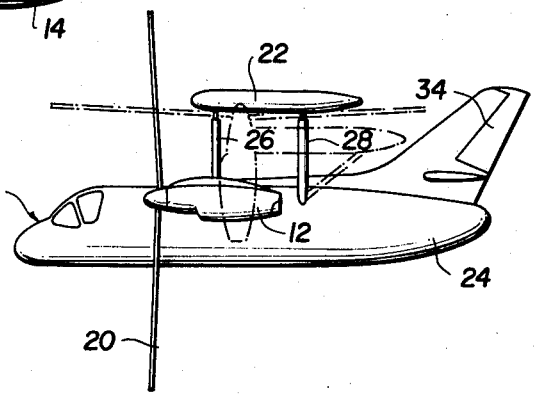
FIG. 2 is a side view of the aircraft shown in FIG. 1.
Figure 3:
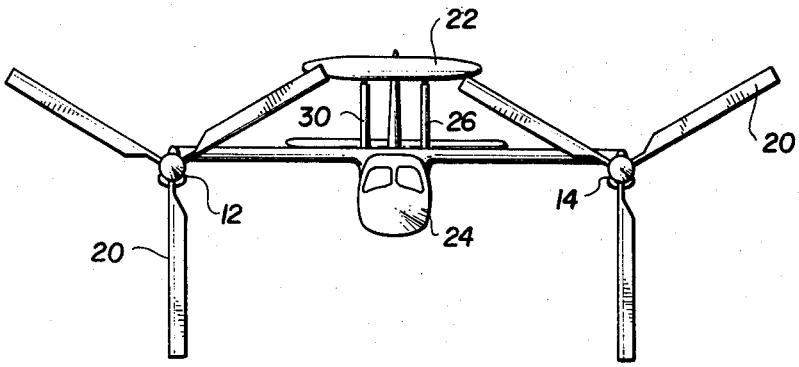
FIG. 3 is a front view of the aircraft shown in FIG. 1.

FIGS. 1–3 show a typical tilt rotor aircraft 10 having two rotor nacelles 12, 14 mounted to the ends of respective wings 16, 18 of the aircraft 10, each rotor having a plurality of rotor blades 20. A radome 22, having a planform which is shaped approximately as an equilateral triangle, is disposed on the top side of the aircraft fuselage 24, and is connected to the aircraft by four struts 26, 28, 30, 32, which are extendable to space the radome 22 above the aircraft fuselage 24, as shown in FIG. 2, and are retractable to position the radome 22 against the fuselage 24, as shown by dashed lines in FIG. 2. Thus the radome position can accommodate a change of aircraft configuration, as with the tilt rotor aircraft in hover configuration. Other types of aircraft, propeller or jet-driven can similarly use this radome to advantage.

Figure 4:
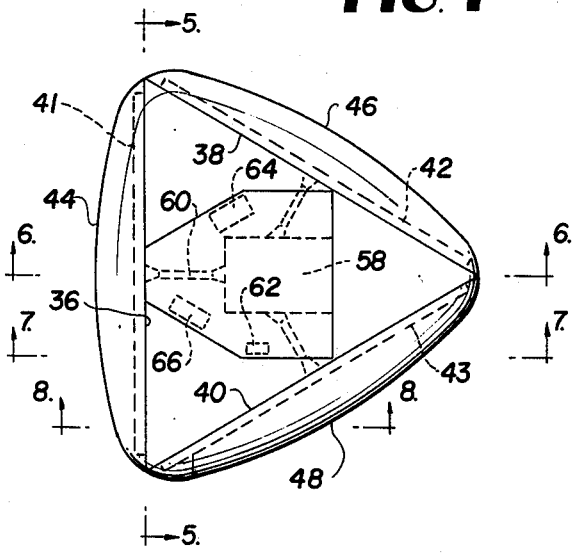
FIG. 4 is a plan view of the delta antenna and radome, with the top wall of the radome removed to show the delta antenna and electronic equipment disposed within the radome.
Figure 5:
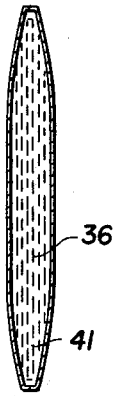
FIGS. 5–8 are cross-sectional side views of the radome shown in FIG. 4, taken along the lines 5—5, 6—6, 7—7 and 8—8, respectively.

As shown in FIG. 4, three groundplanes 36, 38, 40 are disposed within the radome 22 in an equilateral triangular planform. The three groundplanes 36, 38, 40 are generally elliptically shaped to minimize the span and length of the streamlined radome 22 and to cause the proper distribution of antenna elements horizontally and vertically. On their outer sides, the groundplanes 36, 38, 40 carry respective planar arrays 41, 42, 43 of printed-circuit dipoles forming three phased-array antennas, as seen in FIG. 5. The triangular planform of the three groundplanes 36, 38, 40 is symmetrically disposed relative to the aircraft 10, with the groundplane 36 extending orthogonal to the longitudinal axis A-A of the aircraft 10, as shown in FIG. 1.

Figure 7:
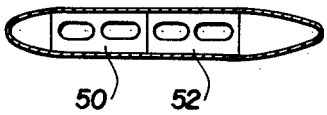
Figure 8:
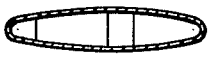

Identical, rounded leading and trailing edges or sides 44, 46, 48 of the radome 22 which extended about the groundplanes 36, 38, 40, respectively, are constructed of nonconductive materials to be maximally transparent to radar. All supporting webs, ribs, spars of the radome 22, such as the spars 50, 52, shown in FIG. 7, the groundplanes 36, 38, 40, and the top and bottom covers 54, 56 are formed from extensively nonconductive composites.

The top and bottom covers 54, 56 of the radome 22 support conventional radar electronic equipment and accessories centrally disposed within the radome 22. As shown in FIG. 4, this conventional radar equipment may include a switched modulator assembly 58 which includes a modulator switch, a plurality of modulators which are connected by coax cables 60 to respective antenna elements of each phased-array antenna 41, 42, 43 in sequence by the modulator switch, and a modulator cooling system. RF power is supplied to the modulators by a RF source 62. Also, a control assembly 64, which includes a transmitter/receiver complex beam forming unit and a modulator switch control unit, and a signal processing assembly 66, which includes IF amplifiers, an analog signal processor and an analog-to-digital converter, are associated with the modulator assembly 58. These conventional electronic assemblies are energized from an electric power cable extending through one of the struts 26, 28, 30, 32 from a power supply within the aircraft fuselage 24.

By operating only one phased-array antenna 41, 42, or 43 at a time and switching the same radar electronic equipment from any one to any other of the three phased-array antennas, the weight and space required for this electronic equipment is reduced to a minimum, while irregular or intermittent scanning on any desired azimuth is still permitted. However, if desired, the three phased-array antennas 41, 42, 43 may be associated with respective radar equipments, so that each phased-array antenna may be operated independently.

Various known electronic circuits and components may be used with the delta arrangement of three phased-array antennas 41, 42, 43 described herein. For example, an electronic beam scanning system similar to that described in U.S. Pat. No. 3,274,601, issued Sept. 20, 1966 to J. Blass, may be used for the side-to-side scanning of each of the three phase array antennas 41, 42, 43. The printed circuit dipoles of each antenna 41, 42, 43 may be similar to those described in U.S. Pat. No. 3,971,125, issued July 27, 1976 to Wilbur H. Thies, Jr.

During a 360 degree scanning operation, the three phased-array antennas 41, 42, 43 are electronically scanned in sequence from side-to-side, with the scanning being limited to 60 degrees on either side of broadside of each array. The range of radar coverage for each antenna will vary proportional to the cosine of the angle between the radar beam and the broadside direction of the antenna. Thus, during the 360 degree scanning operation, the radar coverage range will vary between 50% and 100% of the maximum antenna range during the 120 degree scan of each antenna.

Figure 9:
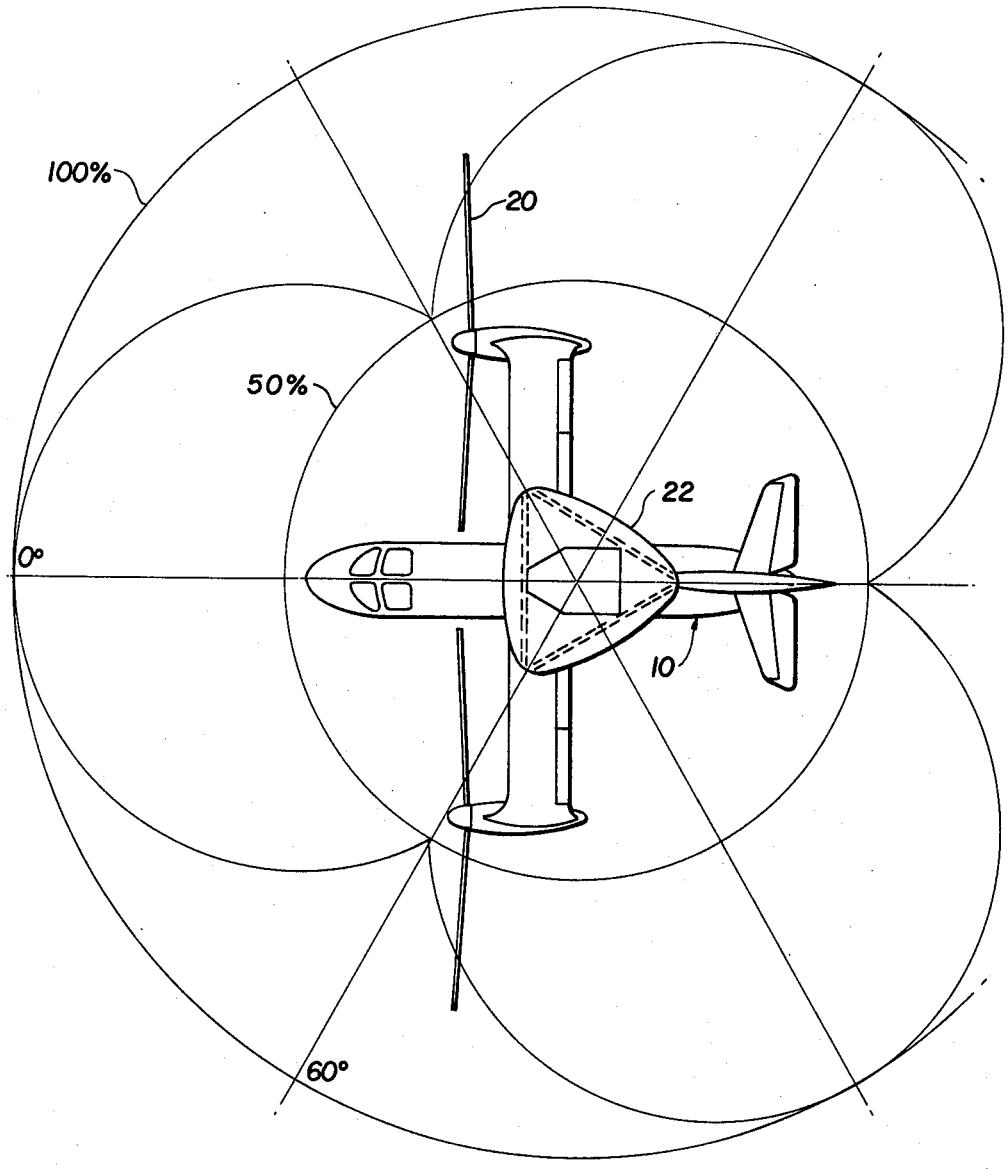
FIG. 9 shows the inherent range patterns of the delta antenna superimposed upon a plan view of the aircraft.

This is illustrated in FIG. 9, which shows the antenna range pattern for the delta arrangement of three planar phased-array antennas 41, 42, 43 described herein. As seen in FIGS. 2 and 3, the tail 34, the rotors 12, 14, and the rotating rotor blades 20 interfere in varying degrees with radar transmission and reception by the three phased-array antennas within the radome 22. To minimize the effect of this interference, the radome 22 is disposed on aircraft fuselage 24 so that the points of maximum interference by the tail 34, rotors 12, 14, and blades 20 coincide with the minimum range points of the delta antenna range pattern, as shown in FIG. 9. By so positioning the radome 22, interference at the maximum range points of the antenna range pattern is reduced to a minimum.

The size of the delta antenna and radome is determined by various design and performance requirements, such as the radar frequency, detection range, and vertical beamwidth. Thus, in the preferred embodiment described herein, which has a radar frequency of 1.3 GHz, a nominal broadside detection range of 350 nautical miles, and a 16° vertical beamwidth, the groundplanes 36, 38, 40, are 2′×16′ generally elliptically-shaped groundplanes carrying respective planar arrays 41, 42, 43 of 178 printed-circuit dipoles, the modulator assembly 58 includes 178 modulators, and the radome 22 has a maximum diameter of 17′. The groundplanes 36, 38, 40, the top and bottom radome covers 54, 56, and various support ribs and spars may include strong, lightweight, honeycomb core structures of resin-impregnated fiber material having inner and outer surfaces formed of two or three layers of resin-impregnated fiberglass or similar material. The curved radome sides 44, 46, 48 may be formed of resin-impregnated fiberglass or the like of sufficient thickness (typically 0.070″) to withstand hail.

SUMMARY OF ADVANTAGES

Figure 6:
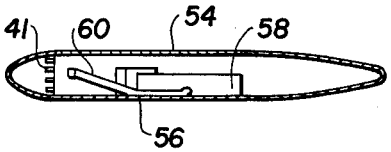

One advantage of the non-rotatable radome 22 having a triangular planform described herein over other non-rotatable radomes having a different shape planform, for example, a circular planform, is that the radome 22 is much easier to streamline aerodynamically. For example, even when flat top and bottom covers 54, 56 are used and the curved leading and trailing edges 44, 46, 48 are made identical for ease of manufacture, the radome is still inherently streamlined in the direction of forward travel of the aircraft, as shown by the longitudinal cross sectional views of the radome 22 in FIGS. 5–7, in which the cross section of the trailing edge 48 is much more tapered than the cross section of the rounded leading edge 44.

Also, the planform area of the triangular-shaped aircraft radar antenna system and radome described herein is less than the planform areas of other aircraft radar antenna systems and radomes having similar design and performance requirements. For example, a cylindrical-shaped radar antenna system, having the same span and height and having the same type antenna elements as the triangular configuration radar antenna system described herein, will enclose a planform area which is approximately 81% larger than the planform area enclosed by the triangular configuration radar antenna system. Further, if the radome for this cylindrical antenna system is aerodynamically streamlined, or at least has a smoothly curved or rounded side surface, the planform area of this radome will be much greater than that of the triangular radome 22 described herein. This is due to the fact that the three phased-array antennas 41, 42, 43 are elliptically-shaped so that the height of these antennas 41, 42, 43 at their ends, which determine the maximum span of the radome 22, is much less than the maximum height of these antennas, whereas the height of a cylindrical radar antenna system is uniform about its periphery.

Further, the area of a cylindrical groundplane, and thus the number of antenna elements carried thereon, will be approximately one-third greater than that of the three groundplanes 36, 38, 40 having the same span and height.

Since the approximately triangular-shaped radome disclosed herein is more easily streamlined aerodynamically and has a smaller planform area than the radome for a cylindrical-shaped radar antenna system, the aerodynamic lift, drag, and moments acting on the triangular configuration antenna system and radome are less than those acting on a cylindrical configuration antenna system and radome of the same span. Consequently, the weight of the triangular configuration radar antenna system and radome is less than that of a cylindrical configuration antenna system and radome. Thus, the aircraft weight penalty for the fixed weight of the radar equipment and for fuel to offset drag is less for the triangular configuration antenna system than for either cylindrical configuration antenna system.

Due to the detrimental effect of side lobes formed in its antenna pattern at large scanning angles, the scanned segment of a cylindrical array of radar antenna elements is limited to about a 90 degree segment. Also, the cylindrical configuration antenna system has a constant cosine loss over the 90 degree scan segment, whereas the triangular configuration antenna system described herein has no cosine loss when the beam is directed broadside of any one of the three planar arrays of antenna elements. Thus, of the aircraft, a cylindrical configuration antenna system will have a constant scanning range which is slightly less than the maximum scanning range of a triangular configuration antenna system having the same antenna span and height, and the same type of antenna elements operated at the same average watts per module.

Since many variations of modifications of this invention are possible in addition to the embodiment specifically described herein, it is intended that the scope of this invention be limited only the appended claims.

What is claimed and desired to be secured by Letters Patent of the United States is:

1. An aircraft radome which comprises:

a housing having approximately triangular-shaped top and bottom walls joined by three side walls of nonconductive material, the housing being connected to the aircraft by at least one support member;

three substantially planar radar antennas disposed within, and affixed to, said housing, the three antennas being arranged in a substantially triangular planform and facing outward respectively toward the three housing side walls, each antenna including a phased array of antenna elements.

2. An aircraft radome, as described in claim 1, which further comprises:

beam forming means for forming a radar beam to be transmitted;

switching means for switching the radar beam to any one of the three antennas; and scanning means for electronically scanning the radar beam from side-to-side in the antenna connected to transmit the radar beam;

wherein said beam forming, switching, and scanning means are disposed in the radome housing between the three antennas.

3. An aircraft radome, as described in claim 1, wherein the three planar antennas are approximately elliptical in shape.

4. An aircraft radome, as described in claim 3, wherein the three planar antennas are substantially identical.

5. An aircraft radome, as described in claim 1, wherein the three housing side walls are substantially identical, rounded walls.

6. An aircraft radome, as described in claim 1, wherein the housing is symmetrically mounted to the aircraft, with one of the three housing side walls facing in a forward direction and constituting a leading edge of the housing.

7. An aircraft radome, as described in claim 1, wherein the at least one support member is an extendable, retractable member having an extended position at which the housing is spaced from the aircraft and a retracted position at which the housing is disposed against the aircraft.

8. An aircraft radome, as described in claim 1, wherein the at least one support member comprises a plurality of support members.

9. An aircraft radome, as described in claim 1, wherein said antenna elements are printed circuit dipoles.

10. In an aircraft radar system, the combination comprising:

a housing having a planform which approximates an equilateral triangle in shape and including triangular top and bottom walls joined by three side walls to define a housing enclosure therebetween, the three side walls being curved outwardly between the top and bottom walls;

housing support means for mounting the housing to the aircraft;

three identical, substantially planar radar antennas disposed in a substantially triangular planform within the housing and facing outward respectively toward the three housing side walls, each antenna including a phased array of antenna elements.

11. An aircraft radome, as described in claim 1, wherein the housing is symmetrically mounted to the aircraft, with one of the three housing side walls facing in a rearward direction and constituting a trailing edge of the housing.

12. In the radar system as described in claim 10, the combination further comprising:

beam forming means for forming a radar beam to be transmitted;

switching means for switching the radar beam to any one of the three antennas; and scanning means for electronically scanning the radar beam from side-to-side in the antenna connected to transmit the radar beam;

wherein said beam forming, switching, and scanning means are dispoed in the housing between the three antennas.

13. In the radar system, as described in claim 10, wherein the three substantially planar antennas are approximately elliptical in shape.

14. In the radar system, as described in claim 13, wherein the three substantially planar antennas are substantially identical.

15. In the radar system, as described in claim 10, wherein the three housing side walls are substantially identical, rounded walls.

16. In the radar system, as described in claim 10, wherein the housing is symmetrically mounted to the aircraft, with one of the three housing side walls facing in a forward direction and constituting a leading edge of the housing.

17. In the radar system, as described in claim 10, wherein the housing support means is an extendable, retractable member having an extended position at which the housing is spaced from the aircraft and a retracted position at which the housing is disposed against the aircraft.

18. In the radar system, as described in claim 10, wherein the housing support means comprises a plurality of support members.

19. In the radar system, as described in claim 10, wherein said antenna elements are printed circuit dipoles.

20. In the radar system, as described in claim 10, wherein the housing is symmetrically mounted to the aircraft, with one of the three housing side walls facing in a rearward direction and constituting a trailing edge of the housing.

* * * * *